US009068134B2

(12) United States Patent
Deckman et al.

(10) Patent No.: US 9,068,134 B2
(45) Date of Patent: Jun. 30, 2015

(54) METHOD FOR IMPROVING ENGINE WEAR AND CORROSION RESISTANCE

(71) Applicant: ExxonMobil Research & Engineering Company, Annandale, NJ (US)

(72) Inventors: Douglas Edward Deckman, Mullica Hill, NJ (US); William L. Maxwell, Pilesgrove, NJ (US); Eugene John Hammerle, Alexandria, VA (US); Walter Thomas Hitchner, Mullica Hill, NJ (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 189 days.

(21) Appl. No.: 13/687,236

(22) Filed: Nov. 28, 2012

(65) Prior Publication Data

US 2013/0143783 A1 Jun. 6, 2013

Related U.S. Application Data

(60) Provisional application No. 61/566,242, filed on Dec. 2, 2011.

(51) Int. Cl.

| | |
|---|---|
| ***C10M 169/04*** | (2006.01) |
| ***C10M 105/32*** | (2006.01) |
| ***C10M 105/06*** | (2006.01) |
| ***C10M 127/04*** | (2006.01) |

(52) U.S. Cl.

CPC ..... *C10M 105/32* (2013.01); *C10M 169/04* (2013.01); *C10M 105/06* (2013.01); *C10M 2290/00* (2013.01); *C10M 127/04* (2013.01); *C10M 2203/06* (2013.01); *C10M 2203/1006* (2013.01); *C10M 2203/1025* (2013.01); *C10M 2205/022* (2013.01); *C10M 2205/024* (2013.01); *C10M 2205/0285* (2013.01); *C10M 2205/04* (2013.01); *C10M 2205/173* (2013.01); *C10M 2207/023* (2013.01); *C10M 2207/024* (2013.01); *C10M 2207/026* (2013.01); *C10M 2207/027* (2013.01); *C10M 2207/04* (2013.01); *C10M 2207/144* (2013.01); *C10M 2207/283* (2013.01); *C10M 2207/289* (2013.01); *C10M 2209/084* (2013.01); *C10M 2215/064* (2013.01); *C10M 2215/28* (2013.01); *C10M 2219/044* (2013.01); *C10M 2219/086* (2013.01); *C10M 2219/087* (2013.01); *C10M 2223/045* (2013.01); *C10N 2210/06* (2013.01); *C10N 2220/029* (2013.01); *C10N 2230/06* (2013.01); *C10N 2230/12* (2013.01); *C10N 2230/42* (2013.01); *C10N 2230/45* (2013.01); *C10N 2230/52* (2013.01); *C10N 2240/10* (2013.01)

(58) Field of Classification Search

CPC ..... C10M 105/06; C10M 169/04; C10M 2290/00

USPC ..... 508/110

See application file for complete search history.

(56) References Cited

U.S. PATENT DOCUMENTS

| | | | |
|---|---|---|---|
| 3,036,003 | A | 5/1962 | Verdol |
| 3,172,892 | A | 3/1965 | LeSuer et al. |
| 3,200,107 | A | 8/1965 | LeSuer |
| 3,215,707 | A | 11/1965 | Rense |
| 3,219,666 | A | 11/1965 | Norman et al. |
| 3,254,025 | A | 5/1966 | LeSuer |
| 3,275,554 | A | 9/1966 | Wagenaar |
| 3,316,177 | A | 4/1967 | Dorer, Jr. |
| 3,329,658 | A | 7/1967 | Fields |
| 3,341,542 | A | 9/1967 | LeSuer |
| 3,413,347 | A | 11/1968 | Worrel |
| 3,438,757 | A | 4/1969 | Honnen et al. |

(Continued)

FOREIGN PATENT DOCUMENTS

| | | |
|---|---|---|
| EP | 0471071 B1 | 8/1995 |
| EP | 1040115 B1 | 6/2004 |
| WO | 9931113 A1 | 6/1999 |

OTHER PUBLICATIONS

K. C. Eapen, C. E. Snyder, Jr., L. Gschwender, S. S. Dua and C. Tamborski, "Poly-n-Alkylbenzene Compounds: A Class of Thermally Stable and Wide Liquid Range Fluids", Symposium on Trends in Lube Oil Basestocks Presented Before the Division of Petroleum Chemistry, Inc., American Chemical Society, Philadelphia Meeting, Aug. 26-31, 1984, pp. 1052-1058.

Dressler, H., R.L. Shubkin (Ed.) "Synthetic Lubricants and High Performance Functional Fluids", Marcel Dekker, N.Y. 1993, chap. 5.

The International Search Report and Written Opinion of PCT/US2012/066926 dated Mar. 21, 2013.

Reid-Peters, Sandy, "Alkylated Naphthalenes", XP055055374, Retrieved from the Internet: URL:http://web.archive.org/web/20111006015607/http://utsrus.com/documents/seminary_doklady/260911/exxon_mobil/5.0_uts_synesstic.pdf [retrieved on Mar. 6, 2013] pp. 7-10, pp. 14-15, Sep. 15, 2011.

(Continued)

*Primary Examiner* — Taiwo Oladapo

(74) *Attorney, Agent, or Firm* — Robert A. Migliorini

(57) ABSTRACT

Provided are lubricating engine oils including a lubricating oil base stock as a major component and an alkylated aromatic base stock as a minor component. One or more of engine wear and corrosion resistance are improved as compared to engine wear and corrosion resistance achieved using a lubricating oil containing a minor component other than the alkylated aromatic base stock, e.g., an ester having a D5293 viscosity of less than 10,000 cP at −35° C. In an engine lubricated with the lubricating oil, one or more of engine wear and corrosion resistance are improved as compared to engine wear and corrosion resistance achieved using a lubricating oil containing a minor component other than the alkylated aromatic base stock, e.g., an ester having a D5293 viscosity of less than 10,000 cP at −35° C. This improvement in engine wear and corrosion control means that engine oils can be formulated with very high saturate content base stocks such as PAOs or GTL stock while providing improved engine durability.

9 Claims, No Drawings

(56) References Cited

U.S. PATENT DOCUMENTS

| | | | |
|---|---|---|---|
| 3,444,170 | A | 5/1969 | Norman et al. |
| 3,449,250 | A | 6/1969 | Fields |
| 3,454,555 | A | 7/1969 | van der Voort et al. |
| 3,454,607 | A | 7/1969 | LeSuer |
| 3,519,565 | A | 7/1970 | Coleman |
| 3,541,012 | A | 11/1970 | Steube |
| 3,565,804 | A | 2/1971 | Honnen et al. |
| 3,630,904 | A | 12/1971 | Musser |
| 3,632,511 | A | 1/1972 | Liao |
| 3,666,730 | A | 5/1972 | Coleman |
| 3,687,849 | A | 8/1972 | Abbott |
| 3,697,574 | A | 10/1972 | Piasek et al. |
| 3,702,300 | A | 11/1972 | Coleman |
| 3,725,277 | A | 4/1973 | Worrel |
| 3,725,480 | A | 4/1973 | Traise et al. |
| 3,726,882 | A | 4/1973 | Traise et al. |
| 3,787,374 | A | 1/1974 | Adams |
| 4,100,082 | A | 7/1978 | Clason et al. |
| 4,234,435 | A | 11/1980 | Meinhardt et al. |
| 4,454,059 | A | 6/1984 | Pindar et al. |
| 4,604,491 | A | 8/1986 | Dressler et al. |
| 4,658,072 | A | 4/1987 | Johnson |
| 4,714,794 | A | 12/1987 | Yoshida et al. |
| 4,827,064 | A | 5/1989 | Wu |
| 4,827,073 | A | 5/1989 | Wu |
| 4,889,647 | A | 12/1989 | Rowan et al. |
| 4,956,122 | A | 9/1990 | Watts et al. |
| 4,978,464 | A | 12/1990 | Coyle et al. |
| 5,034,563 | A | 7/1991 | Ashijian et al. |
| 5,055,626 | A | 10/1991 | Ho et al. |
| 5,171,195 | A | 12/1992 | Funamoto |
| 5,344,578 | A | 9/1994 | Wei et al. |
| 5,371,248 | A | 12/1994 | Rudnick |
| 5,395,538 | A | 3/1995 | Rudnick et al. |
| 5,516,954 | A | 5/1996 | Chang et al. |
| 5,552,071 | A | 9/1996 | Rudnick et al. |
| 5,602,086 | A | 2/1997 | Le et al. |
| 5,705,458 | A | 1/1998 | Roby et al. |
| 6,071,864 | A | 6/2000 | Hsi Ho et al. |
| 6,180,575 | B1 | 1/2001 | Nipe |
| 6,436,882 | B1 | 8/2002 | Rizvi |
| 6,491,809 | B1 | 12/2002 | Briot et al. |
| 6,713,438 | B1 | 3/2004 | Baillargeon et al. |
| 2003/0158055 | A1 | 8/2003 | Deckman et al. |
| 2004/0018944 | A1 | 1/2004 | Wu et al. |
| 2006/0201852 | A1 | 9/2006 | Rosenbaum et al. |
| 2006/0276355 | A1 | 12/2006 | Carey et al. |
| 2007/0289897 | A1 | 12/2007 | Carey et al. |
| 2007/0298990 | A1 | 12/2007 | Carey et al. |
| 2008/0300157 | A1 * | 12/2008 | Wu et al. ..... 508/591 |

OTHER PUBLICATIONS

Mazzo-Skalski, Sandra, "Alkylated Napgthalene Basestocks Advance High-Performance Lubricants", Tribology & Lubrication Technology, Nov. 1, 2009, pp. 38-40, XP055055376, Retrieved from the Internet: URL: http://digital.ipcprintservices.com/publication/?i=24611 [retrieved on Mar. 60, 2013] figures 1, 4-7.

* cited by examiner

METHOD FOR IMPROVING ENGINE WEAR AND CORROSION RESISTANCE

CROSS-REFERENCE TO RELATED APPLICATION

This application claims the benefit of U.S. Provisional Application Ser. No. 61/566,242 filed on Dec. 2, 2011, which is incorporated herein in its entirety by reference.

FIELD

This disclosure relates to lubricating engines using formulated lubricating oils to reduce wear and corrosion in the engine.

BACKGROUND

Lubricants in commercial use today are prepared from a variety of natural and synthetic base stocks admixed with various additive packages and solvents depending upon their intended application. The base stocks typically include mineral oils, poly alpha olefins (PAO), gas-to-liquid base oils (GTL), silicone oils, phosphate esters, diesters, polyol esters, and the like.

A major trend for passenger car engine oils (PCEOs) is an overall improvement in quality as higher quality base stocks become more readily available. Typically the highest quality PCEO products are formulated with highly saturated base stocks such as PAOs or GTL stocks. These highly saturated stocks require the use of Group V base stocks such as ester to improve additive and deposit solubility.

Another major trend is the gradual reduction in the maximum allowable phosphorus contained in an engine oil to improve catalyst life. As the phosphorus content of engine oils is reduced, polar base stocks such as esters can accelerate wear and compromise vehicle durability.

Therefore, there is a need for Group V base fluids that provide appropriate solubility and which also provide excellent wear and corrosion performance.

The present disclosure also provides many additional advantages, which shall become apparent as described below.

SUMMARY

This disclosure is directed in part to a method for improving one or more of wear and corrosion resistance in an engine lubricated with a lubricating oil by using as the lubricating oil a formulated oil comprising a lubricating oil base stock as a major component and an alkylated aromatic base stock as a minor component. One or more of engine wear and corrosion resistance are improved as compared to engine wear and corrosion resistance achieved using a lubricating oil containing a minor component other than the alkylated aromatic base stock, e.g., an ester having a D5293 viscosity of less than 10,000 cP at −35° C.

This disclosure relates in part to a lubricating engine oil comprising a lubricating oil base stock as a major component and an alkylated aromatic base stock as a minor component. In an engine lubricated with the lubricating oil, one or more of engine wear and corrosion resistance are improved as compared to engine wear and corrosion resistance achieved using a lubricating oil containing a minor component other than the alkylated aromatic base stock.

In this disclosure, alkylated aromatic base stocks have been found to improve both engine wear control, and reduce copper and lead corrosion when compared to alternate Group V base stocks such as esters having a D5293 viscosity of less than 10,000 cP at −35° C. This improvement in engine wear and corrosion control means that engine oils can be formulated with very high saturate content base stocks such as PAOs or GTL stock while providing improved engine durability.

Further objects, features and advantages of the present disclosure will be understood by reference to the following detailed description.

DETAILED DESCRIPTION

All numerical values within the detailed description and the claims herein are modified by "about" or "approximately" the indicated value, and take into account experimental error and variations that would be expected by a person having ordinary skill in the art.

This disclosure provides lubricating oils useful as engine oils and in other applications characterized by an excellent balance of anti-wear and anti-corrosion characteristics. The lubricating oils are based on high quality base stocks including a major portion of a hydrocarbon base fluid such as a PAO or GTL with a secondary base stock component which is preferably an alkylated aromatic fluid, such as alkylated naphthalene. The lubricating oil base stock can be any oil boiling in the lube oil boiling range, typically between 100 to 450° C. In the present specification and claims, the terms base oil(s) and base stock(s) are used interchangeably.

Lubricating Oil Base Stocks

A wide range of lubricating oils is known in the art. Lubricating oils that are useful in the present disclosure are both natural oils and synthetic oils. Natural and synthetic oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve the at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as a feed stock.

Groups I, II, III, IV and V are broad categories of base oil stocks developed and defined by the American Petroleum Institute (API Publication 1509; www.API.org) to create guidelines for lubricant base oils. Group I base stocks generally have a viscosity index of between 80 to 120 and contain greater than 0.03% sulfur and less than 90% saturates. Group II base stocks generally have a viscosity index of between 80 to 120, and contain less than or equal to 0.03% sulfur and greater than or equal to 90% saturates. Group III stock generally has a viscosity index greater than 120 and contains less than or equal to 0.03% sulfur and greater than 90% saturates. Group IV includes polyalphaolefins (PAO). Group V base stocks include base stocks not included in Groups I-IV. The table below summarizes properties of each of these five groups.

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | Includes polyalphaolefins (PAO) | | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful in the present disclosure. Natural oils vary also as to the method used for their production and purification; for example, their distillation range and whether they are straight run or cracked, hydrorefined, or solvent extracted.

Group II and/or Group III hydroprocessed or hydrocracked base stocks, as well as synthetic oils such as polyalphaolefins, alkyl aromatics and synthetic esters, i.e. Group IV and Group V oils are also well known base stock oils.

Synthetic oils include hydrocarbon oil such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks, the Group IV API base stocks, are a commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073, which are incorporated herein by reference in their entirety. Group IV oils, that is, the PAO base stocks have viscosity indices preferably greater than 130, more preferably greater than 135, still more preferably greater than 140.

Esters in a minor amount may be useful in the lubricating oils of this disclosure. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols such as the neopentyl polyols; e.g., neopentyl glycol, trimethylol ethane, 2-methyl-2-propyl-1,3-propanediol, trimethylol propane, pentaerythritol and dipentaerythritol with alkanoic acids containing at least 4 carbon atoms, preferably $C_5$ to $C_{30}$ acids such as saturated straight chain fatty acids including caprylic acid, capric acids, lauric acid, myristic acid, palmitic acid, stearic acid, arachic acid, and behenic acid, or the corresponding branched chain fatty acids or unsaturated fatty acids such as oleic acid, or mixtures of any of these materials.

Esters should be used in a amount such that the improved wear and corrosion resistance provided by the lubricating oils of this disclosure are not adversely affected. The esters preferably have a D5293 viscosity of less than 10,000 cP at −35° C.

Non-conventional or unconventional base stocks and/or base oils include one or a mixture of base stock(s) and/or base oil(s) derived from: (1) one or more Gas-to-Liquids (GTL) materials, as well as (2) hydrodewaxed, or hydroisomerized/cat (and/or solvent) dewaxed base stock(s) and/or base oils derived from synthetic wax, natural wax or waxy feeds, mineral and/or non-mineral oil waxy feed stocks such as gas oils, slack waxes (derived from the solvent dewaxing of natural oils, mineral oils or synthetic oils; e.g., Fischer-Tropsch feed stocks), natural waxes, and waxy stocks such as gas oils, waxy fuels hydrocracker bottoms, waxy raffinate, hydrocrackate, thermal crackates, foots oil or other mineral, mineral oil, or even non-petroleum oil derived waxy materials such as waxy materials recovered from coal liquefaction or shale oil, linear or branched hydrocarbyl compounds with carbon number of 20 or greater, preferably 30 or greater and mixtures of such base stocks and/or base oils.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material-derived base stock(s) and/or base oil(s), are characterized typically as having kinematic viscosities at 100° C. of from 2 $mm^2/s$ to 50 $mm^2/s$ (ASTM D445). They are further characterized typically as having pour points of −5° C. to −40° C. or lower (ASTM D97). They are also characterized typically as having viscosity indices of 80 to 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than 10 ppm, and more typically less than 5 ppm of each of these elements. The sulfur and nitrogen content of GTL base stock(s) and/or base oil(s) obtained from F-T material, especially F-T wax, is essentially nil. In addition, the absence of phosphorous and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

Base oils for use in the formulated lubricating oils useful in the present disclosure are any of the variety of oils corresponding to API Group I, Group II, Group III, Group IV, Group V and Group VI oils and mixtures thereof, preferably API Group II, Group III, Group IV, Group V and Group VI oils and mixtures thereof, more preferably the Group III to Group VI base oils due to their exceptional volatility, stability, viscometric and cleanliness features. Minor quantities of Group I stock, such as the amount used to dilute additives for blending into formulated lube oil products, can be tolerated but should be kept to a minimum, i.e. amounts only associated with their use as diluent/carrier oil for additives used on an "as-received" basis. Even in regard to the Group II stocks, it is preferred that the Group II stock be in the higher quality range associated with that stock, i.e. a Group II stock having a viscosity index in the range 100<VI<120.

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e. cycloparaffin) content in such combinations varies with the catalyst and temperature used. Further, GTL base stock(s) and/or base oil(s) and hydrodewaxed, or hydroisomerized/cat (and/or solvent) dewaxed base stock(s) and/or base oil(s) typically have very low sulfur and nitrogen content, generally containing less than 10 ppm, and more typically less than 5 ppm of each of these elements. The sulfur and nitrogen content of GTL base stock(s) and/or base oil(s) obtained from F-T material, especially F-T wax, is essentially nil. In addition, the absence of phosphorous and aromatics make this material especially suitable for the formulation of low sulfur, sulfated ash, and phosphorus (low SAP) products.

The basestock component of the present lubricating oils will typically be from 80 to 99 weight percent of the total composition (all proportions and percentages set out in this specification are by weight unless the contrary is stated) and more usually in the range of 90 to 99 weight percent.

Alkylated Aromatic Base Stock Components

Alkylated aromatic base stock components useful in this disclosure include, for example, alkylated naphthalenes and alkylated benzenes. The alkylated aromatic base stock can be any hydrocarbyl molecule that contains at least 5% of its weight derived from an aromatic moiety such as a benzenoid moiety or naphthenoid moiety, or their derivatives. These alkylated aromatic base stocks include alkyl benzenes, alkyl naphthalenes, alkyl diphenyl oxides, alkyl naphthols, alkyl diphenyl sulfides, alkylated bis-phenol A, alkylated thiodiphenol, and the like. The alkylated aromatic base stock can be mono-alkylated, dialkylated, polyalkylated, and the like. The aromatic can be mono- or poly-functionalized. The hydrocarbyl groups can range from $C_6$ up to $C_{60}$ with a range of $C_8$ to $C_{40}$ often being preferred. A mixture of hydrocarbyl groups is often preferred. The hydrocarbyl group can optionally contain sulfur, oxygen, and/or nitrogen containing substituents. The aromatic group can also be derived from natural (petroleum) sources, provided at least 5% of the molecule is comprised of an above-type aromatic moiety. Viscosities at 100° C. of approximately 3 cSt to 50 cSt are preferred, with viscosities of approximately 3.4 cSt to 20 cSt often being more preferred for the alkylated aromatic base stock. Naphthalene or methyl naphthalene, for example, can be alkylated with olefins such as octene, decene, dodecene, tetradecene or higher, mixtures of similar olefins, and the like.

Illustrative alkylated naphthalenes useful in the present disclosure are described, for example, in U.S. Patent Publication No. 2008/0300157.

Examples of typical alkyl naphthalenes are mono-, di-, tri-, tetra-, or penta-$C_3$ alkyl naphthalene, $C_4$ alkyl naphthalene, $C_5$ alkylnaphthalene, $C_6$ alkyl naphthalene, $C_8$ alkyl naphthalene, $C_{10}$ alkyl naphthalene, $C_{1-2}$ alkyl naphthalene, $C_{1-4}$ alkyl naphthalene, $C_{1-6}$ alkyl naphthalene, $C_{1-8}$ alkyl naphthalene, etc., $C_{10}$-$C_{14}$ mixed alkyl naphthalene, $C_6$-$C_{18}$ mixed alkyl naphthalene, or the mono-, di-, tri-, tetra-, or penta $C_3$, $C_4$, $C_5$, $C_6$, $C_8$, $C_{10}$, $C_{12}$, $C_{14}$, $C_{16}$, $C_{18}$ or mixture thereof alkyl monomethyl, dimethyl, ethyl, diethyl, or methylethyl naphthalene, or mixtures thereof. The alkyl group can also be branched alkyl group with $C_{10}$-$C_{300}$, e.g., $C_{24}$-$C_{56}$ branched alkyl naphthalene, $C_{24}$-$C_{56}$ branched alkyl mono-, di-, tri-, tetra- or penta-$C_1$-$C_4$ naphthalene. These branched alkyl group substituted naphthalenes or branched alkyl group substituted mono-, di-, tri-, tetra- or penta $C_1$-$C_4$ naphthalene can also be used as mixtures with the previously recited materials. These branched alkyl group can be prepared from oligomerization of small olefins, such as $C_5$-$C_{24}$ alpha- or internal-olefins. When the branched alkyl group is very large (that is, 8 to 300 carbons), usually only one or two of such alkyl groups are attached to the naphthalene core. The alkyl groups on the naphthalene ring can also be mixtures of the above alkyl groups. Sometimes mixed alkyl groups are advantageous because they provide more improvement of pour points and low temperature fluid properties. The fully hydrogenated fluid alkylnaphthalenes can also be used for blending with GTL base stockbase oil, but the alkyl naphthalenes are preferred.

Typically the alkyl naphthalenes are prepared by alkylation of naphthalene or short chain alkyl naphthalene, such as methyl or di-methyl naphthalene, with olefins, alcohols or alkylchlorides of 6 to 24 carbons over acidic catalyst inducing typical Friedel-Crafts catalysts. Typical Friedel-Crafts catalysts are $AlCl_3$, $BF_3$, HT, zeolites, amorphous alumniosilicates, acid clays, acidic metal oxides or metal salts, USY, etc.

Methods for the production of alkylnaphthalenes suitable for use in the present disclosure are described in U.S. Pat. Nos. 5,034,563, 5,516,954, and 6,436,882, as well as in references cited in those patents as well as taught elsewhere in the literature. Because alkylated naphthalene synthesis techniques are well known to those skilled in the art as well as being well documented in the literature such techniques will not be further addressed herein.

The naphthalene or mono- or di-substituted short chain alkyl naphthalenes can be derived from any conventional naphthalene-producing process from petroleum, petrochemical process or coal process or source stream. Naphthalene-containing feeds can be made from aromaticization of suitable streams available from the F-T process. For example, aromatization of olefins or paraffins can produce naphthalene or naphthalene-containing component. Many medium or light cycle oils from petroleum refining processes contain significant amounts of naphthalene, substituted naphthalenes or naphthalene derivatives. Indeed, substituted naphthalenes recovered from whatever source, if possessing up to three alkyl carbons can be used as raw material to produce alkylnaphthalene for this disclosure. Furthermore, alkylated naphtahlenes recovered from whatever source or processing can be used in the present method, provided they possess kinematic viscosities, VI, pour point, etc.

Suitable alkylated naphthalenes are available commercially from ExxonMobil under the tradename Synesstic AN or from King Industries under the tradename NA-Lube naphthalene-containing fluids.

Illustrative alkylated benzenes useful in this disclosure include, for example, those described in U.S. Patent Publication 2008/0300157. Alkylated benzenes having a viscosity at 100° C. of 1.5 to 600 cS, VI of 0 to 200 and pour point of 0° C. or less, preferably −15° C. or less, more preferably −25° C. or less, still more preferably −35° C. or less, most preferably −60° C. or less are useful for this disclosure.

Illustrative monoalkylated benzenes include, for example, linear $C_{10}$-$C_{30}$ alkyl benzene or a $C_{10}$-$C_{300}$ branched alkyl benzene, preferably $C_{10}$-$C_{100}$ branched alkyl benene, more preferably $C_{15}$-$C_{50}$ branched alkyl group. Illustrative miltialkylated benzenes include, for example, those in which one or two of the alkyl groups can be small alkyl radical of $C_1$-$C_5$ alkyl group, preferably $C_1$-$C_2$ alkyl group. The other alkyl group or groups can be any combination of linear $C_{10}$-$C_{30}$ alkyl group, or branched $C_{10}$ and higher up to $C_{300}$ alkyl group, preferably $C_{15}$-$C_{50}$ branched alkyl group. These branched large alkyl radicals can be prepared from the oligomerization or polymerization of $C_3$-$C_{20}$, internal or alpha-olefins or mixture of these olefins. The total number of carbons in the alkyl substituents ranged from $C_{10}$-$C_{300}$. Preferred alkyl benzene fluids can be prepared according to U.S. Pat. Nos. 6,071,864 and 6,491,809.

Included in this class of base stock blend components are, for example, long chain alkylbenzenes and long chain alkyl naphthalenes which are preferred materials since they are hydrolytically stable and may therefore be used in combination with the PAO component of the base stock in wet applications. The alkylnaphthalenes are known materials and are described, for example, in U.S. Pat. No. 4,714,794. The use of a mixture of monoalkylated and polyalkylated naphthalene as a base for synthetic functional fluids is also described in U.S. Pat. No. 4,604,491. The preferred alkylnaphthalenes are those having a relatively long chain alkyl group typically from 10 to 40 carbon atoms although longer chains may be used if desired. Alkylnaphthalenes produced by alkylating naphthalene with an olefin of 14 to 20 carbon atoms has particularly good properties, especially when zeolites such as the large pore size zeolites are used as the alkylating catalyst, as described in U.S. Pat. No. 5,602,086. These alkylnaphthalenes are predominantly monosubstituted naphthalenes with attachment of the alkyl group taking place predominantly at the 1- or 2-position of the alkyl chain. The presence of the long chain alkyl groups confers good viscometric properties on the alkyl naphthalenes, especially when used in combination with the PAO components which are themselves materials of high viscosity index, low pour point and good fluidity.

An alternative secondary blending stock is an alkylbenzene or mixture of alkylbenzenes. The alkyl substituents in these fluids are typically alkyl groups of 8 to 25 carbon atoms, usually from 10 to 18 carbon atoms and up to three such substituents may be present, as described in ACS Petroleum Chemistry Preprint 1053-1058. "Poly n-Alkylbenzene Compounds: A Class of Thermally Stable and Wide Liquid Range Fluids", Eapen et al, Phila. 1984. Tri-alkyl benzenes may also be produced by the cyclodimerization of 1-alkynes of 8 to 12 carbon atoms as described in U.S. Pat. No. 5,055,626. Other alkylbenzenes are described in U.S. Pat. No. 4,658,072. Alkylbenzenes have been used as lubricant base stocks, especially for low temperature applications. They are commercially available from producers of linear alkylbenzenes (LABs) such as Vista Chemical Co, Huntsman Chemical Co. as well as ChevronTexaco and Nippon Oil Co. The linear alkylbenzenes typically have good low pour points and low temperature viscosities and VI values greater than 100 together with good solvency for additives. Other alkylated aromatics which may be used when desirable are described, for example, in "Synthetic Lubricants and High Performance Functional Fluids", Dressler, H., chap 5, (R. L. Shubkin (Ed.)), Marcel Dekker, N.Y. 1993.

Also included in this class and with very desirable lubricating characteristics are the alkylated aromatic compounds including the alkylated diphenyl compounds such as the alkylated diphenyl oxides, alkylated diphenyl sulfides and alkylated diphenyl methanes and the alkylated phenoxathins as well as the alkylthiophenes, alkyl benzofurans and the ethers of sulfur-containing aromatics. Lubricant blend components of this type are described, for example, in U.S. Pat. Nos. 5,552,071; 5,171,195; 5,395,538; 5,344,578; and 5,371,248.

The alkylated aromatic base stock component is typically used in an amount from 1% to 15%, preferably 2% to 10%, and more preferably 4% to 8%, depending on the application.

The alkylated aromatic base stock component is preferably present in an amount sufficient for the lubricating oil to pass ASTM Sequence IVA wear test (D6891) and/or ASTM Sequence IIIG wear test (7320). Also, the alkylated aromatic base stock component is preferably present in an amount sufficient for the lubricating oil to pass ASTM D6594 corrosion test and/or D130 corrosion test.

Other Additives

The formulated lubricating oil useful in the present disclosure may additionally contain one or more of the other commonly used lubricating oil performance additives including but not limited to dispersants, other detergents, corrosion inhibitors, rust inhibitors, metal deactivators, other anti-wear agents and/or extreme pressure additives, anti-seizure agents, wax modifiers, viscosity index improvers, viscosity modifiers, fluid-loss additives, seal compatibility agents, other friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973).

The types and quantities of performance additives used in combination with the instant disclosure in lubricant compositions are not limited by the examples shown herein as illustrations.

Viscosity Improvers

Viscosity improvers (also known as Viscosity Index modifiers, and VI improvers) increase the viscosity of the oil composition at elevated temperatures which increases film thickness, while having limited effect on viscosity at low temperatures.

Suitable viscosity improvers include high molecular weight hydrocarbons, polyesters and viscosity index improver dispersants that function as both a viscosity index improver and a dispersant. Typical molecular weights of these polymers are between 10,000 to 1,000,000, more typically 20,000 to 500,000, and even more typically between 50,000 and 200,000.

Examples of suitable viscosity improvers are polymers and copolymers of methacrylate, butadiene, olefins, or alkylated styrenes. Polyisobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

The amount of viscosity modifier may range from zero to 8 wt %, preferably zero to 4 wt %, more preferably zero to 2 wt % based on active ingredient and depending on the specific viscosity modifier used.

Antioxidants

Typical anti-oxidant include phenolic anti-oxidants, aminic anti-oxidants and oil-soluble copper complexes.

The phenolic antioxidants include sulfurized and non-sulfurized phenolic antioxidants. The terms "phenolic type" or "phenolic antioxidant" used herein includes compounds having one or more than one hydroxyl group bound to an aromatic ring which may itself be mononuclear, e.g., benzyl, or poly-nuclear, e.g., naphthyl and spiro aromatic compounds. Thus "phenol type" includes phenol per se, catechol, resorcinol, hydroquinone, naphthol, etc., as well as alkyl or alkenyl and sulfurized alkyl or alkenyl derivatives thereof, and bisphenol type compounds including such bi-phenol compounds linked by alkylene bridges sulfuric bridges or oxygen bridges. Alkyl phenols include mono- and poly-alkyl or alkenyl phenols, the alkyl or alkenyl group containing from 3 to 100 carbons, preferably 4 to 50 carbons and sulfurized derivatives thereof, the number of alkyl or alkenyl groups present in the aromatic ring ranging from 1 to up to the available unsatisfied valences of the aromatic ring remaining after counting the number of hydroxyl groups bound to the aromatic ring.

Generally, therefore, the phenolic anti-oxidant may be represented by the general formula:

$$(R)_x—Ar—(OH)_y$$

where Ar is selected from the group consisting of:

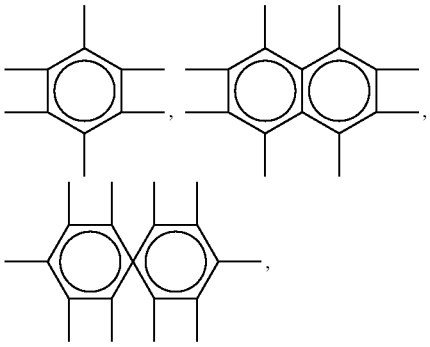

-continued

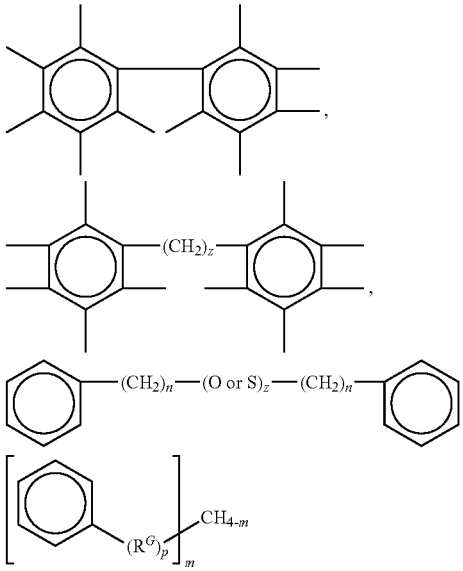

wherein R is a $C_3$-$C_{100}$ alkyl or alkenyl group, a sulfur substituted alkyl or alkenyl group, preferably a $C_4$-$C_{50}$ alkyl or alkenyl group or sulfur substituted alkyl or alkenyl group, more preferably $C_3$-$C_{100}$ alkyl or sulfur substituted alkyl group, most preferably a $C_4$-$C_{50}$ alkyl group, $R^g$ is a $C_1$-$C_{100}$ alkylene or sulfur substituted alkylene group, preferably a $C_2$-$C_{50}$ alkylene or sulfur substituted alkylene group, more preferably a $C_2$-$C_2$ alkylene or sulfur substituted alkylene group, y is at least 1 to up to the available valences of Ar, x ranges from 0 to up to the available valances of Ar-y, z ranges from 1 to 10, n ranges from 0 to 20, and m is 0 to 4 and p is 0 or 1, preferably y ranges from 1 to 3, x ranges from 0 to 3, z ranges from 1 to 4 and n ranges from 0 to 5, and p is 0.

Preferred phenolic anti-oxidant compounds are the hindered phenolics and phenolic esters which contain a sterically hindered hydroxyl group, and these include those derivatives of dihydroxy aryl compounds in which the hydroxyl groups are in the o- or p-position to each other. Typical phenolic anti-oxidants include the hindered phenols substituted with $C_1$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; 2-methyl-6-t-butyl-4-dodecyl phenol; 2,6-di-t-butyl-4 methyl phenol; 2,6-di-t-butyl-4-ethyl phenol; and 2,6-di-t-butyl 4 alkoxy phenol; and

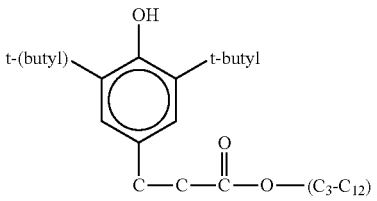

Phenolic type anti-oxidants are well known in the lubricating industry and commercial examples such as Ethanox® 4710, Irganox® 1076, Irganox® L1035, Irganox® 1010, Irganox® L109, Irganox® L118, Irganox® L135 and the like are familiar to those skilled in the art. The above is presented only by way of exemplification, not limitation on the type of phenolic anti-oxidants which can be used.

The phenolic anti-oxidant can be employed in an amount in the range of 0.1 to 3 wt %, preferably 0.25 to 2.5 wt %, more preferably 0.5 to 2 wt % on an active ingredient basis.

Aromatic amine anti-oxidants include phenyl-α-naphthyl amine which is described by the following molecular structure:

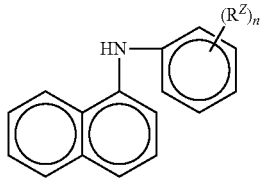

wherein $R^z$ is hydrogen or a $C_1$ to $C_{14}$ linear or $C_3$ to $C_{14}$ branched alkyl group, preferably $C_1$-$C_{10}$ linear or $C_3$-$C_{10}$ branched alkyl group, more preferably linear or branched $C_6$-$C_8$ and n is an integer ranging from 1 to 5 preferably 1. A particular example is Irganox L06.

Other aromatic amine anti-oxidants include other alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to 20 carbon atoms, and preferably contains from 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines anti-oxidants have alkyl substituent groups of at least 6 carbon atoms. Examples of aliphatic groups include hexyl, heptyl, octyl, nonyl, decyl. Generally, the aliphatic groups will not contain more than 14 carbon atoms.

The general types of such other additional amine anti-oxidants which may be present include diphenylamines, phenothiazines, imidodibenzyls and diphenyl phenylene diamines. Mixtures of two or more of such other additional aromatic amines may also be present. Polymeric amine anti-oxidants can also be used.

Another class of anti-oxidant used in lubricating oil compositions and which may also be present are oil-soluble copper compounds. Any oil-soluble suitable copper compound may be blended into the lubricating oil. Examples of suitable copper antioxidants include copper dihydrocarbyl thio- or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are known to be particularly useful.

Such anti-oxidants may be used individually or as mixtures of one or more types of anti-oxidants, the total amount employed being an amount of 0.50 to 5 wt %, preferably 0.75 to 3 wt % (on an as-received basis).

Detergents

In addition to the alkali or alkaline earth metal salicylate detergent which is an optional component in the present disclosure, other detergents may also be present. While such other detergents can be present, it is preferred that the amount employed be such as to not interfere with the synergistic effect attributable to the presence of the salicylate. Therefore, most preferably such other detergents are not employed.

If such additional detergents are present, they can include alkali and alkaline earth metal phenates, sulfonates, carboxylates, phosphonates and mixtures thereof. These supplemental detergents can have total base number (TBN) ranging from neutral to highly overbased, i.e. TBN of 0 to over 500, preferably 2 to 400, more preferably 5 to 300, and they can be present either individually or in combination with each other in an amount in the range of from 0 to 10 wt %, preferably 0.5 to 5 wt % (active ingredient) based on the total weight of the formulated lubricating oil. As previously stated, however, it is preferred that such other detergent not be present in the formulation.

Such additional other detergents include by way of example and not limitation calcium phenates, calcium sulfonates, magnesium phenates, magnesium sulfonates and other related components (including borated detergents).

Dispersants

During engine operation, oil-insoluble oxidation byproducts are produced. Dispersants help keep these byproducts in solution, thus diminishing their deposition on metal surfaces. Dispersants may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,215,707; 3,219,666; 3,316,177; 3,341,542; 3,444,170; 3,454,607; 3,541,012; 3,630,904; 3,632,511; 3,787,374 and 4,234.435. Other types of dispersant are described in U.S. Pat. Nos. 3,036,003; 3,200,107; 3,254.025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines. Molar ratios can vary depending on the amine or polyamine. For example, the molar ratio of alkenyl succinic anhydride to TEPA can vary from 1:1 to 5:1.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine.

The molecular weight of the alkenyl succinic anhydrides will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from 0.1 to 5 moles of boron per mole of dispersant reaction product.

Mannich base dispersants are made from the reaction of alkylphenols, formaldehyde, and amines. Process aids and catalysts, such as oleic acid and sulfonic acids, can also be part of the reaction mixture. Molecular weights of the alkylphenols range from 800 to 2,500 or more.

Typical high molecular weight aliphatic acid modified Mannich condensation products can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average 600-100,000 molecular weight.

Examples of $HN(R)_2$ group-containing reactants are alkylene polyamines, principally polyethylene polyamines. Other representative organic compounds containing at least one $HN(R)_2$ group suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamine reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula $H_2N—(Z—NH—)_nH$, mentioned before, Z is a divalent ethylene and n is 1 to 10 of the foregoing formula. Corresponding propylene polyamines such as propylene diamine and di-, tri-, tetra-, pentapropylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloroalkanes having 2 to 6 carbon atoms and the chlorines on different carbons are suitable alkylene polyamine reactants.

Aldehyde reactants useful in the preparation of the high molecular products useful in this disclosure include the aliphatic aldehydes such as formaldehyde (also as paraformaldehyde and formalin), acetaldehyde and aldol (β-hydroxybutyraldehyde). Formaldehyde or a formaldehyde-yielding reactant is preferred.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from 500 to 5000 or more or a mixture of such hydrocarbylene groups. Other preferred dispersants include succinic acid-esters and amides, alkylphenol-polyamine-coupled Mannich adducts, their capped derivatives, and other related components. Such additives may be used in an amount of 0.1 to 20 wt %, preferably 0.1 to 8 wt %, more preferably 1 to 6 wt % (on an as-received basis) based on the weight of the total lubricant.

Pour Point Depressants

Conventional pour point depressants (also known as lube oil flow improvers) may also be present. Pour point depressant may be added to lower the minimum temperature at which the fluid will flow or can be poured. Examples of suitable pour point depressants include alkylated naphthalenes polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. Such additives may be used in amount of 0.0 to 0.5 wt %, preferably 0 to 0.3 wt %, more preferably 0.001 to 0.1 wt % on an as-received basis.

Corrosion Inhibitors/Metal Deactivators

Corrosion inhibitors are used to reduce the degradation of metallic parts that are in contact with the lubricating oil composition. Suitable corrosion inhibitors include aryl thiazines, alkyl substituted dimercapto thiodiazoles thiadiazoles and mixtures thereof. Such additives may be used in an amount of 0.01 to 5 wt %, preferably 0.01 to 1.5 wt %, more preferably 0.01 to 0.2 wt %, still more preferably 0.01 to 0.1 wt % (on an as-received basis) based on the total weight of the lubricating oil composition.

Seal Compatibility Additives

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride and sulfolane-type seal swell agents such as Lubrizol 730-type seal swell additives. Such additives may be used in an amount of 0.01 to 3 wt %, preferably 0.01 to 2 wt % on an as-received basis.

Anti-Foam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 percent, preferably 0.001 to 0.5 wt %, more preferably 0.001 to 0.2 wt %, still more preferably 0.0001 to 0.15 wt % (on an as-received basis) based on the total weight of the lubricating oil composition.

Inhibitors and Antirust Additives

Anti-rust additives (or corrosion inhibitors) are additives that protect lubricated metal surfaces against chemical attack by water or other contaminants. One type of anti-rust additive is a polar compound that wets the metal surface preferentially, protecting it with a film of oil. Another type of anti-rust additive absorbs water by incorporating it in a water-in-oil emulsion so that only the oil touches the surface. Yet another type of anti-rust additive chemically adheres to the metal to produce a non-reactive surface. Examples of suitable additives include zinc dithiophosphates, metal phenolates, basic metal sulfonates, fatty acids and amines. Such additives may be used in an amount of 0.01 to 5 wt %, preferably 0.01 to 1.5 wt % on an as-received basis.

In addition to the ZDDP anti-wear additives which are essential components of the present disclosure, other anti-wear additives can be present, including zinc dithiocarbamates, molybdenum dialkyldithiophosphates, molybdenum dithiocarbamates, other organo molybdenum-nitrogen complexes, sulfurized olefins, etc.

The term "organo molybdenum-nitrogen complexes" embraces the organo molybdenum-nitrogen complexes described in U.S. Pat. No. 4,889,647. The complexes are reaction products of a fatty oil, dithanolamine and a molybdenum source. Specific chemical structures have not been assigned to the complexes. U.S. Pat. No. 4,889,647 reports an infrared spectrum for a typical reaction product of that disclosure; the spectrum identifies an ester carbonyl band at 1740 $cm^{-1}$ and an amide carbonyl band at 1620 $cm^{-1}$. The fatty oils are glyceryl esters of higher fatty acids containing at least 12 carbon atoms up to 22 carbon atoms or more. The molybdenum source is an oxygen-containing compound such as ammonium molybdates, molybdenum oxides and mixtures.

Other organo molybdenum complexes which can be used in the present disclosure are tri-nuclear molybdenum-sulfur compounds described in EP 1 040 115 and WO 99/31113 and the molybdenum complexes described in U.S. Pat. No. 4,978,464.

In the above detailed description, the specific embodiments of this disclosure have been described in connection with its preferred embodiments. However, to the extent that the above description is specific to a particular embodiment or a particular use of this disclosure, this is intended to be illustrative only and merely provides a concise description of the exemplary embodiments. Accordingly, the disclosure is not limited to the specific embodiments described above, but rather, the disclosure includes all alternatives, modifications, and equivalents falling within the true scope of the appended claims. Various modifications and variations of this disclosure will be obvious to a worker skilled in the art and it is to be understood that such modifications and variations are to be included within the purview of this application and the spirit and scope of the claims.

EXAMPLES

Aniline point is a measure of solvency for additives and lubricant degradation products. Fluids with low aniline points have very desirable solvency properties. As shown in Table 1 below, Group V base stocks have low aniline points and very desirable solvency properties. Group V base stocks are often used in combination with a highly saturated base stock to improve solvency.

TABLE 1

| Description | API Group | Aniline Point, ° C. | Saturates, % | KV100C, cSt |
|---|---|---|---|---|
| PAO 4 | IV | 121 | 100 | 4.1 |
| PAO 6 | IV | 127 | 100 | 5.8 |
| Visom 4 | III | 119 | 98 | 4.1 |
| Visom 6 | III | 127 | 98 | 6.6 |
| Yubase 4 PLUS | III | 119 | 98 | 4.1 |
| AN | V | 26 | na | 4.75 |
| $C_8/C_{10}$ TMP Ester | V | 0 | na | 4.35 |

Engine oils were formulated using two different Group V base stocks, alkylated naphthalene, and trimethylolpropane (TMP) ($C_8/C_{10}$) ester. The blended oils were evaluated in the Sequence IIIG (D7320) engine test and in the Sequence IVA (D6891) engine test. The wear performance results are set forth in Table 2 below.

As shown in Table 2, in the IIIG engine test, when alkylated naphthalene was used as the Group V base stock, a wear result of 10 microns was achieved. When TMP ester was used as the Group V base stock, the wear increased from 10 microns to 43 microns. Also shown in Table 2 are the IIIG engine test wear results for two low phosphorus (450 ppm) formulations. When an engine oil was formulated with 7% AN, 69μ of wear resulted. When an engine oil was formulated with TMP ester, 150μ of wear resulted.

TABLE 2

Sequence IIIG (D7320) Engine Test Data

| Method Description | Test 1 | Test 2 | Test 3 | Test 4 |
|---|---|---|---|---|
| Polyisobutenyl succinic dispersant | 5.5 | 5.5 | 5 | 5 |
| Overbased detergent system | 2.73 | 2.73 | 3.52 | 3.52 |
| $C_3/C_6$ 2° ZDDP (A) | 0.86 | 0.86 | | |
| $C_3/C_6$ 2° ZDDP (B) | | | 0.45 | 0.45 |
| Ashless Antioxidant | 1.5 | 1.5 | 1 | 1 |
| Defoamant | 0.1 | 0.1 | 0.1 | 0.1 |
| Hydroxy ester friction modifier | 0.25 | 0.25 | 0.5 | 0.5 |
| PMA Pour Point Depressant | 0.3 | 0.3 | | |
| Organo Molybdenum FM | 0.15 | 0.15 | | |
| Polymer VI Improver Type A (concentrate) | | | 9.4 | 9.4 |
| Polymeric VI Improver Type B (solid polymer) | 0.75 | 0.75 | | |
| hydrocarbyl alkylated naphthalene | 5 | | 7 | |
| $C_8/C_{10}$ TMP Ester | | 5.3 | | 7 |
| 117 VI Group II | 45.11 | 44.81 | | |
| Group IV PAO | 37.75 | 37.75 | 73.03 | 73.03 |
| Ash, D874 | 1.0 | 1.0 | 1.0 | 1.0 |
| TBN, D2896 | 9.0 | 9.0 | 8.9 | 8.9 |
| TBN, D4739 | 8.0 | 8.0 | 7.9 | 7.9 |
| P, ppm | 760 | 760 | 450 | 450 |
| IIIG Cam + Lifter Wear, μ | 10 | 43 | 69 | 150 |

As shown in Table 3, in the IVA engine test (D6891), when alkylated naphthalene was used as the Group V base stock, a wear result of 86 microns was achieved. When TMP ester was used as the Group V base stock, the wear increased from 86 microns to 124 microns.

TABLE 3

Sequence IVA (D6891) Engine Test Data

| Method Description | Test 1 | Test 2 |
|---|---|---|
| Polyisobutenyl succinic dispersant | 5 | 5 |
| Hydroxy ester friction modifier | 0.5 | 0.5 |

TABLE 3-continued

| Sequence IVA (D6891) Engine Test Data | | |
|---|---|---|
| Method Description | Test 1 | Test 2 |
| $C_3/C_6$ 2° ZDDP (B) | 0.45 | 0.45 |
| Overbased Detergent system | 3.52 | 3.52 |
| Ashless Antioxidant | 0.7 | 0.7 |
| Defoamant | 0.1 | 0.1 |
| Polymeric Viscosity Index Improver concentrate (Type B) | 9.4 | 9.4 |
| Group IV PAO | 73.33 | 73.33 |
| $C_8/C_{10}$ TMP Ester | | 7 |
| hydrocarbyl alkylated naphthalene | 7 | |
| Ash, D874 | 1.0 | 1.0 |
| TBN, D2896 | 9.0 | 9.0 |
| TBN, D4739 | 7.4 | 7.4 |
| P, ppm | 450 | 450 |
| Sequence IVA 7-pt wear, μ | 86 | 124 |

Engine oils were formulated using three different Group V base stocks, i.e., alkylated naphthalene, TMP ($C_8/C_{10}$) ester, and Esterex™ M11 ester. Esterex™ M11 ester is available from ExxonMobil Corporation. The blended oils were evaluated for copper and lead corrosion using D130 and D6594 tests. The copper and lead corrosion results are set forth in Tables 4 and 5 below.

In the D130 copper corrosion test, when alkylated naphthalene was used as the Group V basestock, an excellent low corrosion result of "1A" was obtained on the copper strip. When TMP ester was used as the Group V base stock, the copper corrosion increased from 1A to 1B.

TABLE 4

| D130 Copper Corrosion Data | | |
|---|---|---|
| Method Description | Test 1 | Test 2 |
| Polyisobutenyl succinic dispersant | 5.3 | 5.3 |
| Overbased detergent system | 2.73 | 2.73 |
| $C_3/C_6$ 2° ZDDP (A) | 0.86 | 0.86 |
| Ashless Antioxidant | 1.5 | 1.5 |
| Hydroxy ester friction modifier | 0.17 | 0.17 |
| Defoamant | 0.1 | 0.1 |
| Pour Point Depressant | 0.3 | 0.3 |
| Polymeric Viscosity Index Improver (Type B) | 0.696 | 0.648 |
| Group IV PAO | 33.144 | 33.192 |
| 117 VI Group II | 50 | 50 |
| $C_8/C_{10}$ TMP Ester | 0.2 | 5 |
| hydrocarbyl alkylated naphthalene | 4.8 | 0 |
| Ash, D874 | 1.0 | 1.0 |
| TBN, D2896 | 9.0 | 9.0 |
| TBN, D4739 | 8.0 | 8.0 |
| P, ppm | 760 | 760 |

In the D6594 copper and lead corrosion test, when alkylated naphthalene was used as the Group V base stock, a copper corrosion was 38 ppm and lead corrosion was 22 ppm. When TMP ester was used as the Group V base stock, copper corrosion increased from 38 ppm to 644 ppm. The lead corrosion increased from 22 ppm to 47 ppm. When Esterex™ M11 ester was used as the Group V base stock, copper corrosion did not change. However, the lead corrosion increased from 22 ppm to 740 ppm.

TABLE 5

| D6594 Copper and Lead Corrosion Data | | | |
|---|---|---|---|
| Method Description | Test 1 | Test 2 | Test 3 |
| Detergent Inhibitor Additive System | 3.66 | 3.66 | 3.66 |

TABLE 5-continued

| D6594 Copper and Lead Corrosion Data | | | |
|---|---|---|---|
| Method Description | Test 1 | Test 2 | Test 3 |
| Hydroxy ester friction modifier | 1 | 1 | 1 |
| Polymeric viscosity index improver type B | 2.74 | 2.74 | 2.74 |
| Group IV PAO | 71.65 | 71.65 | 71.65 |
| C8/C10 TMP Ester | | 20.95 | |
| Hydrocarbyl alkylated naphthalene | 20.95 | | |
| Ester | | | 20.95 |
| Ash, D874 | 0.5 | 0.5 | 0.5 |
| TBN, D2896 | 1.8 | 1.8 | 1.8 |
| TBN, D4739 | 2.0 | 2.0 | 2.0 |
| P, ppm | 1000 | 1000 | 1000 |

The following examples are made as 0 W viscosity grade oils and are formulated to have a HTHS (ASTM D4683) viscosity of equal to or less than 2.4 cP at 150° C. The compositions are set forth in Table 6 below.

TABLE 6

| Compositional Data | | | | |
|---|---|---|---|---|
| Composition | A1 | A2 | A3 | A4 |
| Alkaline earth metal salicylate | 2.8 | | | |
| Alkaline earth metal salicylate + phenate | | 2.8 | | |
| Alkaline earth metal salicylate + sulfonate | | | 2.8 | |
| Alkaline earth metal phenate + sulfonate | | | | 2.8 |
| ZDDP - secondary alcohol derived | 0.7 | 0.7 | 0.7 | 0.7 |
| ZDDP - secondary alcohol derived + primary alcohol derived | | | | |
| Viscosity index improver - vinylarene/diene AB copolymer | 0.4 | | | |
| Viscosity index improver - hydrogenated polyisoprene star polymer | | 0.2 | | |
| Viscosity index improver - ethylene propylene copolymer | | | 0.2 | |
| Viscosity index improver - functionalized ethylene α-olefin copolymer | | | | 1.0 |
| Dispersant - hydrocarbyl substituted succinimide | | | | |
| Dispersant - borated hydrocarbyl substituted succinimide | | | | |
| Ashless antioxidant - hindered phenolic | | | | |
| Ashless antioxidant - diaryl amine | | | | |
| Friction modifier - ashless | | | | |
| Friction modifier - molybdenum dithiocarbamate | | | | |
| Other additives - including dispersant, antioxidant and friction modifier unless itemized above, pour point depressant and seal swell additive | 7.0 | 7.0 | 7.0 | 7.0 |
| Base oil | Balance | Balance | Balance | Balance |
| Composition | A5 | A6 | A7 | A8 |
| Alkaline earth metal salicylate | 2.8 | 1.5 | | 1.5 |
| Alkaline earth metal salicylate + phenate | | | | |
| Alkaline earth metal salicylate + sulfonate | | | 1.5 | |

TABLE 6-continued

| Compositional Data | | | | |
|---|---|---|---|---|
| Alkaline earth metal phenate + sulfonate | | | | |
| ZDDP - secondary alcohol derived | | 0.8 | 0.8 | 0.8 |
| ZDDP - secondary alcohol derived + primary alcohol derived | | | | |
| Viscosity index improver - vinylarene/diene AB copolymer | 0.2 | | | |
| Viscosity index improver - hydrogenated polyisoprene star polymer | | | | |
| Viscosity index improver - ethylene propylene copolymer | | | | |
| Viscosity index improver - functionalized ethylene α-olefin copolymer | 1.0 | | | |
| Dispersant - hydrocarbyl substituted succinimide | | 2.0 | 2.0 | 2.5 |
| Dispersant - borated hydrocarbyl substituted succinimide | | 2.0 | 2.0 | 2.0 |
| Ashless antioxidant - hindered phenolic | | 0.5 | 0.5 | 1.0 |
| Ashless antioxidant - diaryl amine | | 0.5 | 0.5 | 1.0 |
| Friction modifier - ashless | | 1.0 | 1.0 | 1.0 |
| Friction modifier - molybdenum dithiocarbamate | | 0.5 | 0.5 | 0.8 |
| Other additives - including dispersant, antioxidant and friction modifier unless itemized above, pour point depressant and seal swell additive | 7.0 | 0.5 | 0.5 | 0.5 |
| Base oil | Balance | Balance | Balance | Balance |

| Composition | A9 | A10 | A11 | A12 |
|---|---|---|---|---|
| Alkaline earth metal salicylate | | 1.5 | | |
| Alkaline earth metal salicylate + phenate | | | 1.5 | |
| Alkaline earth metal salicylate + sulfonate | 1.5 | | | 1.5 |
| Alkaline earth metal phenate + sulfonate | | | | |
| ZDDP - secondary alcohol derived | 0.7 | 0.5 | 0.3 | 0.3 |
| ZDDP - secondary alcohol derived + primary alcohol derived | | | | |
| Viscosity index improver - vinylarene/diene AB copolymer | | | | |
| Viscosity index improver - hydrogenated polyisoprene star polymer | | | | |
| Viscosity index improver - ethylene propylene copolymer | | | | |
| Viscosity index improver - functionalized ethylene α-olefin copolymer | | | | |
| Dispersant - hydrocarbyl substituted succinimide | 2.5 | 2.5 | 4.0 | 4.0 |
| Dispersant - borated hydrocarbyl substituted succinimide | 2.0 | 2.5 | | |
| Ashless antioxidant - hindered phenolic | 1.0 | 1.0 | 0.4 | 0.4 |
| Ashless antioxidant - diaryl amine | 1.0 | 1.0 | | |
| Friction modifier - ashless | 1.0 | 1.0 | | |
| Friction modifier - molybdenum dithiocarbamate | 0.8 | 0.5 | 0.8 | 0.8 |
| Other additives - including dispersant, antioxidant and friction modifier unless itemized above, pour point depressant and seal swell additive | 0.5 | 0.5 | 0.5 | 0.5 |

TABLE 6-continued

| Compositional Data | | | | |
|---|---|---|---|---|
| Base oil | Balance | Balance | Balance | Balance |

| Composition | A13 | A14 | A15 | A16 |
|---|---|---|---|---|
| Alkaline earth metal salicylate | | 1.5 | 1.5 | 4.0 |
| Alkaline earth metal salicylate + phenate | | | | |
| Alkaline earth metal salicylate + sulfonate | | | | |
| Alkaline earth metal phenate + sulfonate | 1.5 | | | |
| ZDDP - secondary alcohol derived | 0.3 | 0.3 | | 0.4 |
| ZDDP - secondary alcohol derived + primary alcohol derived | | | 0.3 | |
| Viscosity index improver - vinylarene/diene AB copolymer | | | | |
| Viscosity index improver - hydrogenated polyisoprene star polymer | | | | |
| Viscosity index improver - ethylene propylene copolymer | | | | |
| Viscosity index improver - functionalized ethylene α-olefin copolymer | | | | |
| Dispersant - hydrocarbyl substituted succinimide | 4.0 | 4.0 | 4.0 | 4.0 |
| Dispersant - borated hydrocarbyl substituted succinimide | | | | |
| Ashless antioxidant - hindered phenolic | 0.4 | 0.4 | 0.4 | 0.4 |
| Ashless antioxidant - diaryl amine | | | | |
| Friction modifier - ashless | | | | |
| Friction modifier - molybdenum dithiocarbamate | 0.8 | 0.8 | 0.8 | 0.8 |
| Other additives - including dispersant, antioxidant and friction modifier unless itemized above, pour point depressant and seal swell additive | 0.5 | 0.5 | 0.5 | 0.5 |
| Base oil | Balance | Balance | Balance | Balance |

| Composition | A17 | A18 | A19 | A20 |
|---|---|---|---|---|
| Alkaline earth metal salicylate | | | | |
| Alkaline earth metal salicylate + phenate | 4.0 | | | |
| Alkaline earth metal salicylate + sulfonate | | 4.0 | | |
| Alkaline earth metal phenate + sulfonate | | | 4.0 | 4.0 |
| ZDDP - secondary alcohol derived | 0.4 | 0.4 | 0.4 | |
| ZDDP - secondary alcohol derived + primary alcohol derived | | | | 0.4 |
| Viscosity index improver - vinylarene/diene AB copolymer | | | | |
| Viscosity index improver - hydrogenated polyisoprene star polymer | | | | |
| Viscosity index improver - ethylene propylene copolymer | | | | |
| Viscosity index improver - functionalized ethylene α-olefin copolymer | | | | |
| Dispersant - hydrocarbyl substituted succinimide | 4.0 | 4.0 | 4.0 | 4.0 |
| Dispersant - borated hydrocarbyl substituted succinimide | | | | |
| Ashless antioxidant - hindered phenolic | 0.4 | 0.4 | 0.4 | 0.4 |
| Ashless antioxidant - diaryl amine | | | | |
| Friction modifier - ashless | | | | |

TABLE 6-continued

| Compositional Data | | | | |
|---|---|---|---|---|
| Friction modifier - molybdenum dithiocarbamate | 0.8 | 0.8 | 0.8 | 0.8 |
| Other additives - including dispersant, antioxidant and friction modifier unless itemized above, pour point depressant and seal swell additive | 0.5 | 0.5 | 0.5 | 0.5 |
| Base oil | Balance | Balance | Balance | Balance |

| Composition | A21 | A22 | A23 | A24 |
|---|---|---|---|---|
| Alkaline earth metal salicylate | 2.0 | | | |
| Alkaline earth metal salicylate + phenate | | 2.0 | | |
| Alkaline earth metal salicylate + sulfonate | | | 2.0 | |
| Alkaline earth metal phenate + sulfonate | | | | 2.0 |
| ZDDP - secondary alcohol derived | 0.5 | 0.5 | 0.5 | 0.5 |
| ZDDP - secondary alcohol derived + primary alcohol derived | | | | |
| Viscosity index improver - vinylarene/diene AB copolymer | | | | |
| Viscosity index improver - hydrogenated polyisoprene star polymer | 0.2 | 0.2 | 0.2 | 0.2 |
| Viscosity index improver - ethylene propylene copolymer | | | | |
| Viscosity index improver - functionalized ethylene α-olefin copolymer | | | | |
| Dispersant - hydrocarbyl substituted succinimide | 3.5 | 3.5 | 3.5 | 3.5 |
| Dispersant - borated hydrocarbyl substituted succinimide | 1.0 | 1.0 | | |
| Ashless antioxidant - hindered phenolic | 1.0 | 1.0 | 1.0 | 1.0 |
| Ashless antioxidant - diaryl amine | 2.0 | 2.0 | 2.0 | 2.0 |
| Friction modifier - ashless | 1.0 | 1.0 | 1.0 | 1.0 |
| Friction modifier - molybdenum dithiocarbamate | 0.8 | 0.8 | 0.8 | 0.8 |
| Other additives - including dispersant, antioxidant and friction modifier unless itemized above, pour point depressant and seal swell additive | 0.5 | 0.5 | 0.5 | 0.5 |
| Base oil | Balance | Balance | Balance | Balance |

| Composition | A25 |
|---|---|
| Alkaline earth metal salicylate | |
| Alkaline earth metal salicylate + phenate | |
| Alkaline earth metal salicylate + sulfonate | 4.0 |
| Alkaline earth metal phenate + sulfonate | |
| ZDDP - secondary alcohol derived | 0.5 |
| ZDDP - secondary alcohol derived + primary alcohol derived | |
| Viscosity index improver - vinylarene/diene AB copolymer | |
| Viscosity index improver - hydrogenated polyisoprene star polymer | 0.2 |
| Viscosity index improver - ethylene propylene copolymer | |
| Viscosity index improver - functionalized ethylene α-olefin copolymer | |
| Dispersant - hydrocarbyl substituted succinimide | 3.5 |
| Dispersant - borated hydrocarbyl substituted succinimide | |
| Ashless antioxidant - hindered phenolic | 1.0 |
| Ashless antioxidant - diaryl amine | 2.0 |
| Friction modifier - ashless | |
| Friction modifier - molybdenum dithiocarbamate | 0.8 |
| Other additives - including dispersant, antioxidant and friction modifier unless itemized above, pour point depressant and seal swell additive | 0.5 |
| Base oil | Balance |

For purposes of this disclosure including the compositions set forth in Table 6 above, the alkaline earth metal salicylates, phenates and sulfonates can be derived from calcium and/or magnesium, and can be neutral salts or low, medium or highly overbased detergents or mixtures of same.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

The invention claimed is:

1. A method for improving one or more of wear and corrosion resistance in an engine lubricated with a lubricating oil by using as the lubricating oil a formulated oil comprising a lubricating oil base stock as a major component, wherein the lubricating oil base stock comprises a Group IV base stock at 71.65 to 73.33 wt. % or combination of a Group II and Group IV base stock, wherein the Group II base stock ranges from 45.11 to 50.0 wt. % and the Group IV base stock ranges from 33.14 to 37.75 wt. %, a hydrocarbyl alkylated naphthalene base stock at from 4 to 20.95 wt. %, an organo molybdenum friction modifier at from 0 to 0.15 wt. %, and a secondary alcohol derived ZDDP at a loading that contributes from 450 to 1000 ppm of phosphorous to the lubricating engine oil; wherein one or more of engine wear and corrosion resistance are improved as compared to engine wear and corrosion resistance achieved using a lubricating oil containing a Group V base stock other than the hydrocarbyl alkylated naphthalene base stock.

2. The method of claim 1 wherein the Group IV base stock comprises a poly alpha olefin (PAO) base stock.

3. The method of claim 1 wherein the Group V basestock other than the alkylated aromatic base stock comprises an ester having a D5293 viscosity of less than 10,000 cP at −35° C.

4. The method of claim 1 wherein the lubricating oil passes ASTM Sequence IVA wear test (D6891) and/or ASTM Sequence IIIG wear test (7320).

5. The method of claim 1 wherein the lubricating oil passes ASTM D6594 corrosion test and/or D130 corrosion test.

6. The method of claim 1 wherein the lubricating oil further comprises one or more of a viscosity improver, antioxidant, detergent, dispersant, pour point depressant, corrosion inhibitor, metal deactivator, seal compatibility additive, anti-foam agent, inhibitor, and anti-rust additive.

7. The method of claim 1 in which the lubricating oil is a passenger vehicle engine oil.

8. A lubricating engine oil comprising a lubricating oil base stock as a major component, wherein the lubricating oil base stock comprises a Group IV base stock at 71.65 to 73.33 wt. % or combination of a Group II and Group IV base stock, wherein the Group II base stock ranges from 45.11 to 50.0 wt. % and the Group IV base stock ranges from 33.14 to 37.75 wt. %, a hydrocarbyl alkylated naphthalene base stock at from 4 to 20.95 wt. %, an organo molybdenum friction modifier at from 0 to 0.15 wt. %, and a secondary alcohol derived ZDDP at a loading that contributes from 450 to 1000 ppm of phosphorous to the lubricating engine oil; wherein one or more of engine wear and corrosion resistance are improved as compared to engine wear and corrosion resistance achieved using a lubricating oil containing a Group V base stock other than the hydrocarbyl alkylated naphthalene base stock.

9. The lubricating engine oil of claim 8 wherein the Group IV base stock comprises a poly alpha olefin (PAO) base stock.

* * * * *